United States Patent [19]

Willard

[11] Patent Number: 4,948,127

[45] Date of Patent: Aug. 14, 1990

[54] HEIGHT ADJUSTABLE BASKETBALL BACKBOARD MOUNTING ASSEMBLY

[76] Inventor: Mark Willard, 13320 33rd Ave. N., Plymouth, Minn. 55441

[21] Appl. No.: 165,925

[22] Filed: Mar. 9, 1988

[51] Int. Cl.[5] ..... A63B 63/08
[52] U.S. Cl. ..... 273/1.5 R
[58] Field of Search ..... 273/1.5 R; 248/641, 248/656

[56] References Cited

U.S. PATENT DOCUMENTS

| | | | |
|---|---|---|---|
| 2,397,755 | 4/1946 | Schwab | 248/656 |
| 2,916,288 | 12/1959 | Chervenka | 273/1.5 R |
| 3,627,241 | 12/1971 | Santirocco | 248/656 |
| 3,881,724 | 5/1975 | Beveridge | 273/1.5 R |
| 4,577,827 | 3/1986 | Eliscu | 248/656 |
| 4,643,422 | 2/1987 | Cramblett | 273/1.5 R |

FOREIGN PATENT DOCUMENTS 633340 11/1982 Switzerland ..... 273/1.5 R

OTHER PUBLICATIONS

Washington Post, 3/4/1987, p. C7, Tank McNamara.

*Primary Examiner*—Paul E. Shapiro

[57] ABSTRACT

An height adjustable backboard assembly having a pair of vertically oriented concentric glide tubes, the inner of which may slide within the outer. The top and bottom of the inner glide tubes are connected to mounting brackets to which a basketball backboard may be fastened. The outer glide tubes are connected to a pair of cross bracket members which are in turn fastened to an existing support frame extending from the wall or ceiling adjacent a basketball court. The inner glide tubes may be moved relative to the outer glide tubes by a threaded screw shaft which is carried in a shaft housing permitting free rotation of the screw shaft, and rotated by a hand crank or motor.

8 Claims, 3 Drawing Sheets

HEIGHT ADJUSTABLE BASKETBALL BACKBOARD MOUNTING ASSEMBLY

BACKGROUND OF THE INVENTION

The present invention relates generally to the backboards and goals for the game of basketball, and more particularly to an height adjustable mounting assembly for same.

Basketball goals generally comprise a horizontally oriented circular hoop supporting a cylindrical net with an open bottom, the hoop being attached to a vertical backboard constructed from wood or plexiglass. The backboards are generally mounted on a frame, either freestanding in the case of an outdoor court, or suspended from ceiling rafters or extending from a wall in the case of an indoor gymnasium.

The height of the hoop is generally set at approximately ten feet from the floor of the court, however it may be desirable in some instances to vary this height to accommodate younger or shorter players. This is particularly true in elementary, junior high, and high school physical education or sports settings, where the range of heights of the students varies dramatically between various ages.

The concept of altering or adjusting the height of the backboard has been disclosed, various methods being shown in U.S. Pat. Nos. 3,669,450; 4,145,044; 3,722,886; 3,622,155; 3,650,530; and 3,602,505. Each of these patents disclose a height adjustable backboard, some depending upon where the backboard is mounted relative to the eaves of a house, others permitting vertical adjustment through a telescoping support stand, while others disclosing a trailer mounted backboard with an a pivotable support frame. Retractable backboard frames mounted to the wall or ceiling are also well known.

Assemblies for replacing existing backboards in gymnasiums with height adjustable backboards are presently being marketed One example of such an adjustable basketball backboard assembly is manufactured by the Porter Athletic Co. of Schiller Park, Ill. This system is primarily designed to be an addition to Porter's existing frame structure, although it might also be used to convert other types of backboards into height adjustable backboards if the non-standard support frames were modified. A similar design by AALCO and marketed through Hauenstein & Burmeister of Minneapolis, Minnesota, utilizes an acme screw and awning type crank, with the assembly being connected to the support frame in the same manner as the Porter assembly above.

There are several disadvantages in attempting to utilize the existing height adjustable backboard assemblies to replace fixed backboards mounted to the variety of frame structures found in school gymnasiums and public access court facilities. One such drawback is the fact that these assemblies provide only a short stroke length (i.e., the backboard height may only be varied over a range of approximately two feet, from 8'–10'), because of the mounting bracket structure. Further, they require that the backboard be displaced inwardly toward the center of the court from the frame by approximately one foot or more. This greatly increases the leverage applied to the support frame by the backboard and goal, especially if students "slam dunk" or hang from the hoops. Moreover, the process of mounting these assemblies generally requires custom alteration of the existing frame structures, including cutting and welding pipes and brackets to the existing frame, thereby increasing the cost and time involved in installation. Since the lower end of the drive screw in these models is also generally positioned at the bottom of the mounting frame, any adaption for using a power drive means adding a lower portion to the existing frame.

BRIEF SUMMARY OF THE INVENTION

It is therefore one object of this invention to design a height adjustable backboard assembly which may be easily and inexpensively mounted to a variety of existing backboard frames.

It is another object of this invention to design the above assembly such that the height of the backboard may be varied through a larger range of heights than previously provided.

It is an additional object of this invention to design the above assembly such that the backboard is displaced a minimum distance from the existing frame, to thereby decrease the leverage applied to the frame by the assembly, an minimize any incursion into the court space by the goal.

It is yet another object of this invention to design the above assembly such that it may be operated manually or by a power driven motor without altering the structure of the assembly.

It is a distinct object of this invention to design the above assembly such that it utilizes a minimum of materials, and such that those materials allow for an assembly and mounting method which avoids the complication of cutting and welding tubular pipe members.

Briefly described, the height adjustable backboard mounting assembly of this invention comprises a pair of vertically oriented concentric glide tubes, the inner of which may slide within the outer. The top and bottom of the inner glide tubes are connected to mounting brackets to which a basketball backboard may be fastened. The outer glide tubes are connected to a pair of cross bracket members which are in turn fastened to an existing support frame extending from the wall or ceiling adjacent a basketball court. The inner glide tubes may be moved relative to the outer glide tubes by a threaded screw shaft which is carried in a shaft housing permitting free rotation of the screw shaft, and rotated by a hand crank or motor.

DESCRIPTION OF THE PREFERRED EMBODIMENTS

The height adjustable backboard mounting assembly of this invention is shown in FIGS. 1–5 and referenced generally therein by the numeral 10. It is anticipated that the adjustable backboard mounting assembly 10 may be used with conventional support frames in gymnasiums or outdoor basketball courts, or mounted to a trailer for use in different locations, with the trailer having a support frame which may be pivoted or extended to the full height of a basketball support frame.

Figure 1:
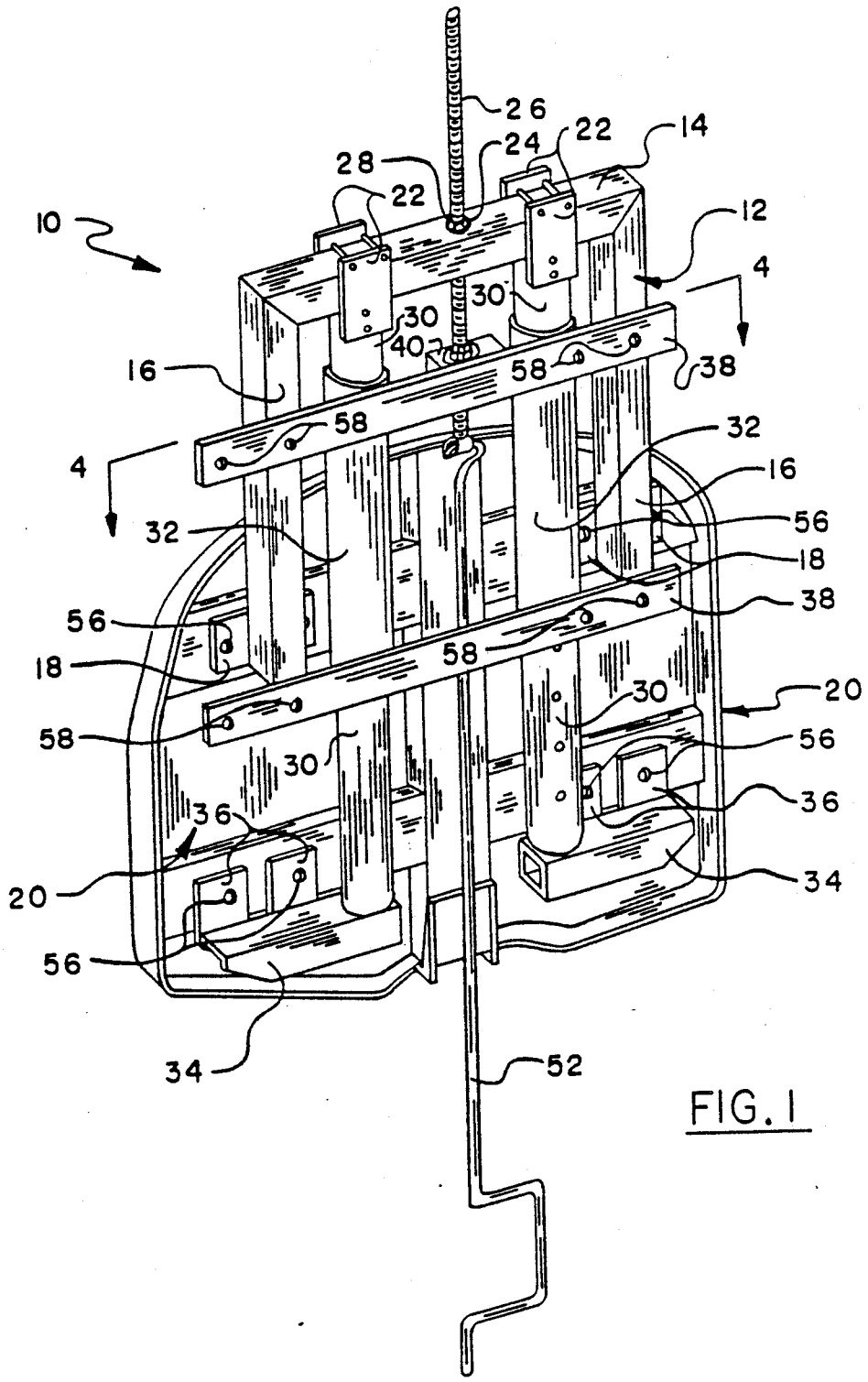
FIG. 1 is a perspective view of the height adjustable backboard mounting assembly of this invention taken from the rear.
Figure 2:
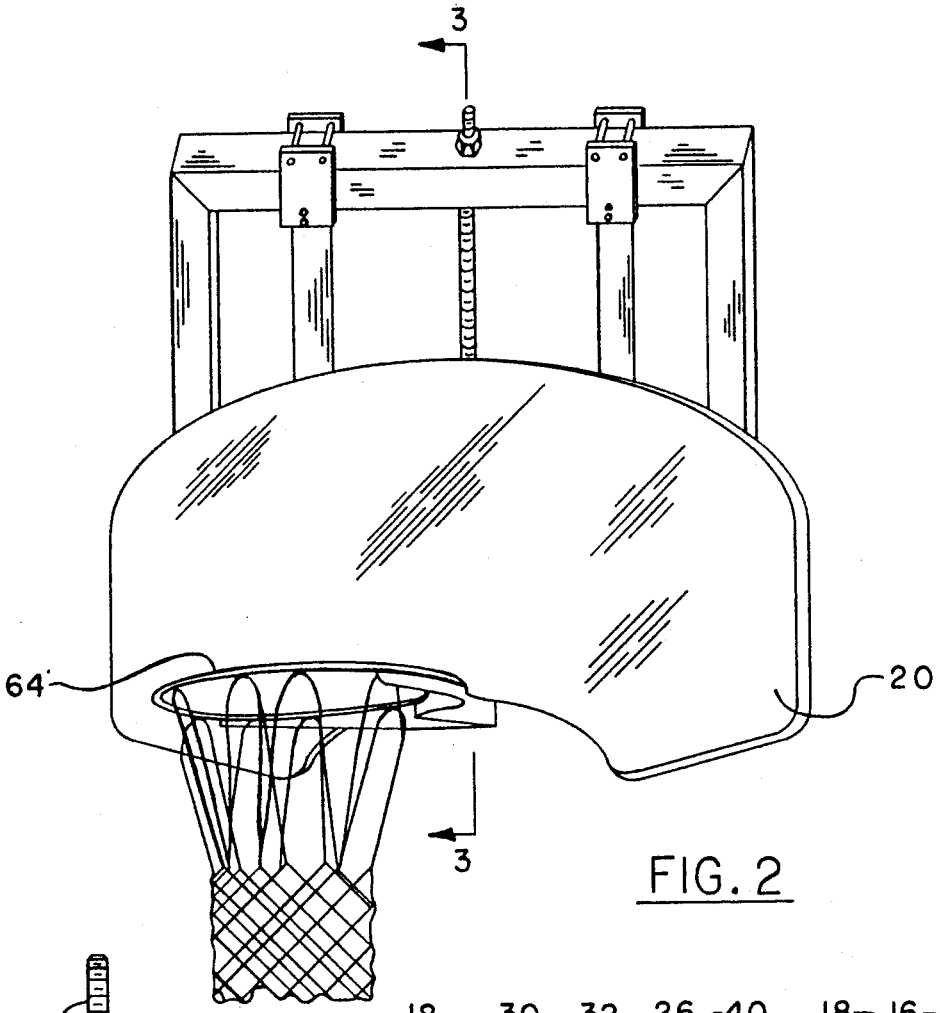
FIG. 2 is a front perspective view of the height adjustable backboard mounting assembly of FIG. 1.

Referring to FIG. 1, it may be seen that the adjustable basketball background assembly of the present invention comprises a top backboard frame 12 consisting of a horizontal cross member 14 with a pair of vertical support members 16 depending from each end of the horizontal cross member 14. Fixedly attached to the bottom end of each vertical support member 16 is a mounting flanges 18 to which a basketball backboard 20 may be fastened using any conventional means. The top backboard support 12 also has two pair of end connection plates 22 removably attached in bracketing relation to the horizontal cross member 14. The horizontal cross member 14 of the top backboard frame 12 also defines an aperture 24 through which a threaded screw shaft 26 is rotatably received. The threaded screw shaft 26 is set apart and held in place relative to the aperture 24 by a threaded hex nut 28 or other swivel assembly known to the art, such that the screw shaft 26 may be removed from the aperture 24 if desired, and such that rotation of the screw shaft 26 will exert force of the cross member 14.

The end connection plates 22 are connected to the top ends of and thereby support a pair of generally cylindrical inner glide tubes 30 or similar first glide members, each of which are slidably received within the generally longitudinal bores defined by outer glide tubes 32 or connected to and carried on other second glide members. The inner glide tubes 30 are positioned directly beneath the cross member 14 and are thus centered along a generally vertical plane, as are the horizontal cross member 14 and vertical support members 16. The inner glide tubes 30 each have an outwardly extending member 34 attached to the bottom end thereof, with a pair of upwardly extending tabs 36 attached to the front side of the outwardly extending members 34.

The outer glide tubes 32 are held in parallel alignment by a pair of mounting bracket members 38 which in some instances may each consist of a pair of outwardly extending flange members rather than a continuous bracket member 38. The upper of mounting bracket member 38 serves as a stationary cross member with respect to the ground and has a screw shaft housing 40 attached to the front side thereof such that the screw shaft housing 40 is positioned between the glide tubes 30, 32 and similarly lies in generally the same plane as the horizontal cross member 14 and the vertical support members 16. Since the vertical stroke length of the backboard mounting assembly 10 will be defined by the distance between the top of the outwardly extending members 34 and the bottom of the outer glide tubes 32, the bottom of the outer glide tubes should extend downwardly no more than necessary to attach to the bottom cross bracket member 38. In some applications, it may be sufficient to have utilize only the upper mounting flanges 18 to mount and support the backboard 20, thus eliminating the outwardly extending members 34 and permitting the backboard mounting assembly 10 to be moved through a range of heights limited only by the length of the inner glide tubes 30.

Figure 3:
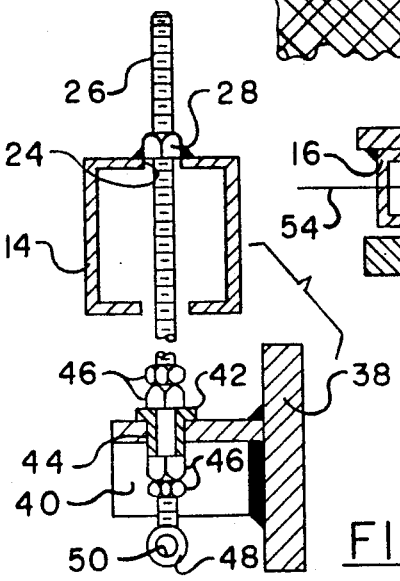
FIG. 3 is a cross sectional view of the height adjustment screw shaft and screw shaft housing taken through line 3—3 of FIG. 2.

Referring to FIG. 3, it may be seen that the screw shaft 26 is rotatably received within and threadedly engages the screw shaft housing 40 by means of one or more rotatable bushings 42 received in apertures 44 in the top and bottom walls of the housing 40, and secured thereto using a pair of opposing locking hex nuts 46. Attached to the bottom end of the screw shaft 26 is a crank holder 48 in the form of a short, generally cylindrical tube defining a bore 50 having a diameter suitably sized to receive the upper end of an awning type crank 52.

The top backboard support 14 thereby serves as a vertically traveling cross member when the crank 52 is used to rotate the screw shaft 26, which thus raises or lowers the backboard 20 relative to the outer glide tubes 32 and cross brackets 38 depending upon the direction of rotation of the screw shaft 26.

Figure 4:
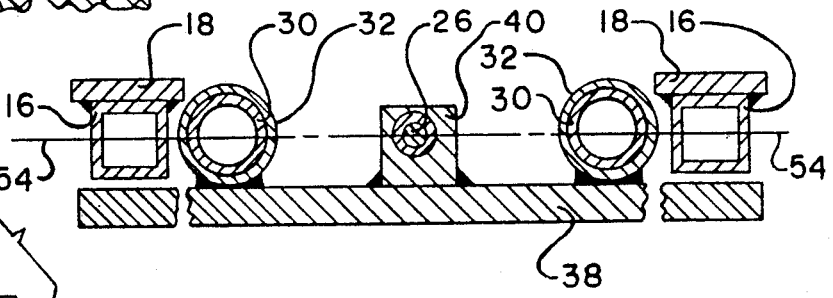
FIG. 4 is a cross sectional view from above of the structural components of the mounting assembly of FIG. 1 taken through line 4—4 of FIG. 1.

Referring to FIG. 4, it may be seen that the inner and outer glide tubes 30, 32, screw shaft 26 and housing 40, and vertical support members 16 are aligned or centered along a generally horizontal center line 54. As such, the distance between the front face of the cross bracket members 38 and the rear face of the mounting flanges 18 may be minimized, and is limited only by the depths or diameters of the inner and outer glide tubes 30, 32, screw shaft 26 and housing 40, and vertical support members 16.

Figure 5:
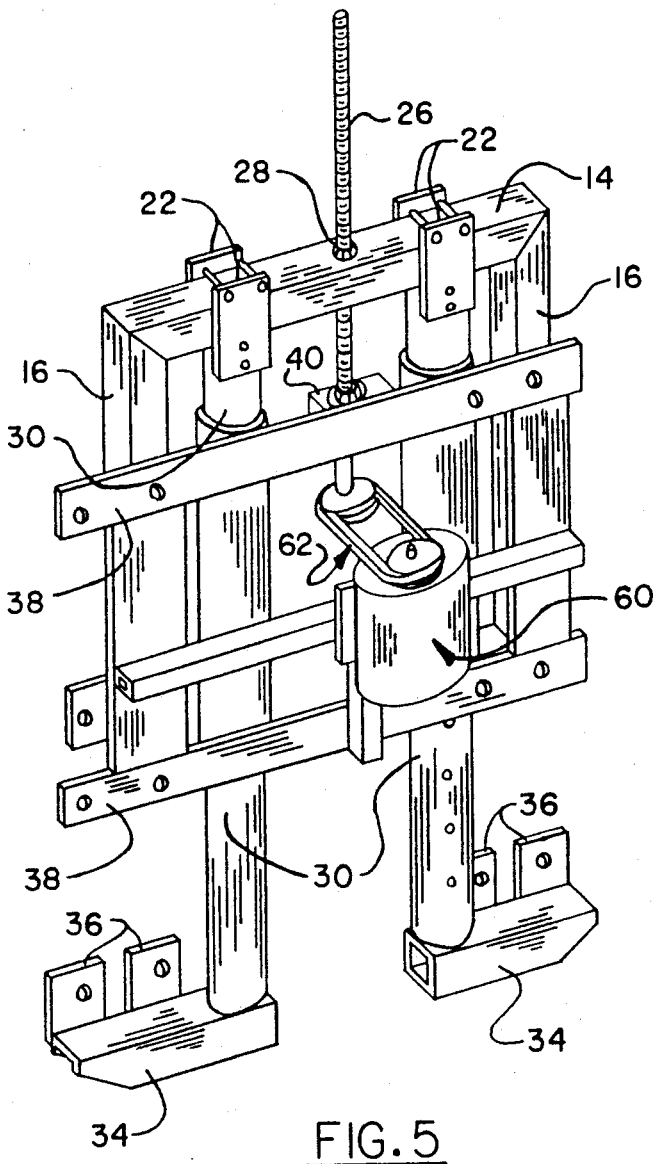
FIG. 5 is a perspective view of an alternate embodiment of the height adjustable backboard mounting assembly utilizing a power driven screw.

It may be seen that this configuration permits a low end support for the screw shaft 26 and any necessary swivel coupling, and the two point suspension of the shaft 26 provides additional stability in the event a non-in-line power drive is used, as shown in FIG. 5.

The lengths, heights, placement, and number of the mounting flanges 18 and tabs 36 may be varied so as to accommodate the largest variety of backboard configurations presently marketed, although the configuration as shown in FIG. 1 has proven suitable. Each mounting flange 18 and tab 36 may include a plurality of predrilled mounting holes 56 to alleviate the need for drilling those holes during installation. Similarly, the cross brackets 38 may be provided with a plurality of predrilled holes 58 to accommodate the variety of existing support frames which may be encountered in gymnasiums and courts.

It is also contemplated that the top of the outer glade tubes 32 may be connected directly to the cross member 14, with the inner tubes 30 connected by one or more horizontal brackets 38, thus allowing the outer glide tubes 32 to move with the backboard 20. The cross member 14 could also define two apertures to slidingly and snugly receive the inner glide tubes 30 with collars or bushings, thus permitting the frame member 12 to be carried on the glide tubes 30.

Referring to FIG. 5, an alternate embodiment of the adjustable height backboard mounting assembly 10 of FIG. 1 is shown, that alternate embodiment utilizing a power drive motor 60 connected to the bottom of the screw shaft 26 by a belt and pulley assembly 62 for rotating the screw shaft 26. It is anticipated that such an embodiment would permit the use of a reversible electric motor, particularly of the type currently used to power electric garage door openers, or a non-reversible motor and slip clutch (not shown) to raise and lower the backboard mounting assembly 10. In this instance, the motor 60 may be electrically connected to a wall mounted control panel, or in the case of exterior or outdoor courts, to a hand-held remote signal controller and transmitter such as the type used with garage door openers, so that an individual could remotely raise and lower the basket assemblies, preferably at each end of the court at the same time to achieve equal heights. In such case, limit switches (not shown) may be included depending from the horizontal cross member 14 to prevent over-raising of the backboard and overloading of the motor 60.

To aid in height adjustment, it is anticipated that the inner glide tubes 30 may be provided with a series of predetermined markings corresponding to a reference point on the bottom of the outer glide tubes 32 which would correspond to the height of the hoop 64 from the floor of the court.

It will be appreciated by those skilled in the art that the foregoing is intended to be illustrative of a preferred embodiment of the a height adjustable backboard mounting assembly 10 of this invention. It is understood that various changes and modifications may be made without departing from the spirit and scope of the appended claims.

What is claimed is:

1. An adjustable backboard mounting assembly to which a basketball backboard having a hoop and a lower edge may be mounted, said adjustable backboard mounting assembly being mountable to a support frame positioned adjacent a basketball court such that said hoop is elevated at a height above said court, said backboard mounting assembly comprising:

a pair of laterally spaced apart fixed generally vertical first glide members;

a bracket member for attaching said first glide members to the support frame comprising a vertically spaced pair of horizontal bars, each being connected to both first glide members;

a pair of laterally spaced apart movable generally vertical second glide members, each second glide member being mounted for slideable movement relative to one of said first glide members, each said second glide member having a length and being oriented generally parallel to said first glide member to which said second glide member is connected;

a frame member comprising a first horizontal cross member disposed above and spanning across the top of and connected to both said second glide members and extending laterally beyond said second glide members at each end and slidable therewith relative to the first glide members, and a vertical support member depending generally vertically downward from each end of the horizontal cross member, said horizontal cross member, both vertical support members and both pairs of said glide members lying in a common plane;

adjustment means for moving said frame member and said second glide members relative to the first glide members, said adjustment means being connected between said horizontal cross member and said bracket member and permitting the frame member to be selectively moved in a vertical direction upwardly away from the court and downwardly toward the court;

mounting means for mounting the backboard to said mounting assembly such that the first and the second glide members do not extend substantially below the lower edge of the backboard when the frame member is moved upwardly away from the court, and such that said mounting means does not interfere with or obstruct the vertical movement of the second glide member over the entire length of the second glide member, comprising mounting tabs secured to the lower ends of said vertical members and said second pair of glide members;

whereby the adjustment means may be used to selectively move the frame member and second glide members up or down relative to the first glide members and the support member, thereby selectively raising or lowering the height of the hoop relative to the court.

2. The adjustable backboard mounting assembly of claim 1 wherein the cross member, vertical support members, first and second glide members, and adjustment means for moving the frame member are each substantially centered on a common horizontal line.

3. The adjustable backboard mounting assembly of claim 1 wherein each of the first glide members comprise an outer tube defining a longitudinal bore extending therethrough, each of the second glide members being received within one of said longitudinal bores of the outer tubes and slidably carried therein.

4. The adjustable backboard mounting assembly of claim 3 wherein the outer tubes are generally cylindrical, the bores each have a cross section which is generally circular with a diameter, and the second glide members each being generally cylindrical and each having a diameter less than the diameter of the bore slidably receiving the second glide member.

5. The adjustable backboard mounting assembly of claim 1 wherein the adjustment means for moving the frame member and the second glide members relative to the first glide members comprises:

a threaded screw shaft, said screw shaft being rotatably connected to and threadedly engaging said horizontal cross member , said screw shaft further being rotatably connected to and threadedly engaging a portion of the bracket member, such that rotation of the screw shaft in a first direction will cause the frame member and the bracket member to move relative to one another in order top raise the height of the hoop, and rotation of the screw shaft in a direction opposite the first direction will cause the frame member and the bracket member to move relative to one another in order to lower the height of the hoop.

6. The adjustable backboard mounting assembly of claim 5 further comprising:

a screw shaft housing, said screw shaft housing being connected to the bracket member and further defining at least one aperture extending therethrough, said screw shaft being rotatably received within said aperture

7. The adjustable backboard mounting assembly of claim 6 wherein the horizontal cross member defines an aperture extending therethrough, said aperture in said cross member rotatably receiving the screw shaft, said cross member, screw shaft, screw shaft housing, and first and second glide members are each substantially centered on a common horizontal line.

8. The adjustable backboard mounting assembly of claim 5 further comprising:

a reversible power drive means for rotating the screw shaft in the first direction and in the direction opposite the first direction.

* * * * *